US010998633B2

(12) United States Patent
Nasimuddin et al.

(10) Patent No.: US 10,998,633 B2
(45) Date of Patent: May 4, 2021

(54) COMPACT WIDEBAND HIGH GAIN CIRCULARLY POLARIZED ANTENNA

(71) Applicant: Agency for Science, Technology and Research, Singapore (SG)

(72) Inventors: Nasimuddin, Singapore (SG); Xianming Qing, Singapore (SG)

(73) Assignee: Agency for Science, Technology and Research, Singapore (SG)

( * ) Notice: Subject to any disclaimer, the term of this patent is extended or adjusted under 35 U.S.C. 154(b) by 0 days.

(21) Appl. No.: 16/499,460

(22) PCT Filed: Mar. 19, 2018

(86) PCT No.: PCT/SG2018/050118
§ 371 (c)(1),
(2) Date: Sep. 30, 2019

(87) PCT Pub. No.: WO2018/182507
PCT Pub. Date: Oct. 4, 2018

(65) Prior Publication Data

US 2020/0076082 A1 Mar. 5, 2020

(30) Foreign Application Priority Data

Mar. 31, 2017 (SG) ..... 10201702690U

(51) Int. Cl.
*H01Q 9/04* (2006.01)
*H01Q 21/06* (2006.01)

(52) U.S. Cl.
CPC ..... *H01Q 9/0428* (2013.01); *H01Q 9/045* (2013.01); *H01Q 21/065* (2013.01)

(58) Field of Classification Search
CPC .. H01Q 9/0428; H01Q 9/0421; H01Q 21/065; H01Q 9/0414; H01Q 9/045; H01Q 9/0442; H01Q 21/24
See application file for complete search history.

(56) References Cited

U.S. PATENT DOCUMENTS 2,644,090 A * 6/1953 Dorne ..... H01Q 13/18 343/769
5,565,875 A * 10/1996 Buralli ..... H01Q 9/0464 343/700 MS (Continued)

FOREIGN PATENT DOCUMENTS

CN 104821432 A 8/2015
WO 2014080360 A2 5/2014

OTHER PUBLICATIONS

Chen et al., "Circularly Polarized Stacked Annular-Ring Microstrip Antenna with Integrated Feeding Network for UHF RFID Readers," IEEE Antennas and Wireless Propagation Letters, vol. 9, 2010, pp. 542-545.

(Continued)

*Primary Examiner* — Graham P Smith
*Assistant Examiner* — Jae E Kim
(74) *Attorney, Agent, or Firm* — Winstead PC

(57) ABSTRACT

A compact wideband single feed circularly polarized antenna is provided. The circularly polarized antenna may include a ground plane. The circularly polarized antenna may include a radiating patch with an embedded ring-shaped slot. The circularly polarized antenna may include a via that shorts a round section of the radiating patch surrounded by the ring-shaped slot to the ground plane. The circularly polarized antenna may include a coaxial feed. The inner conductive material of the coaxial feed may be connected to the radiating patch and the outer conductive material of the coaxial feed may touch the ground plane. The circularly polarized antenna may include a slit-slotted parasitic square patch.

20 Claims, 15 Drawing Sheets

(56) References Cited

U.S. PATENT DOCUMENTS 6,097,345 A * 8/2000 Walton ..... H01Q 1/1271 343/700 MS
7,436,363 B1 * 10/2008 Klein ..... H01Q 5/00 343/700 MS
9,899,744 B1 * 2/2018 Contopanagos ..... H04B 5/0037
10,283,868 B1 * 5/2019 Breed ..... H01Q 9/0442
2005/0243005 A1 * 11/2005 Rafi ..... H01Q 5/357 343/767
2006/0103576 A1 * 5/2006 Mahmoud ..... H01Q 9/0435 343/700 MS
2006/0265034 A1 * 11/2006 Aknine ..... A61B 18/1815 607/101
2007/0085741 A1 * 4/2007 Rafi ..... H01Q 9/0428 343/700 MS
2008/0012710 A1 * 1/2008 Sadr ..... G06K 7/10356 340/572.1
2008/0204326 A1 * 8/2008 Zeinolabedin Rafi ..... H01Q 9/0414 343/700 MS
2009/0218524 A1 * 9/2009 Kare ..... H01Q 15/0086 250/505.1
2010/0060535 A1 * 3/2010 Tiezzi ..... H01Q 5/40 343/770
2010/0090903 A1 * 4/2010 Byun ..... H01Q 13/18 343/700 MS
2010/0207830 A1 * 8/2010 Parsche ..... H01Q 9/0435 343/732
2010/0245204 A1 * 9/2010 Lee ..... H01Q 9/045 343/860
2010/0327068 A1 * 12/2010 Chen ..... H01L 23/66 235/492
2012/0007781 A1 * 1/2012 Kim ..... H01Q 1/2283 343/700 MS
2012/0146869 A1 * 6/2012 Holland ..... H01Q 21/061 343/795
2012/0223869 A1 * 9/2012 Kim ..... H01Q 5/314 343/769
2012/0319922 A1 * 12/2012 Fuchs ..... H01Q 1/243 343/872
2013/0038492 A1 * 2/2013 Abe ..... H01Q 9/0428 343/700 MS
2013/0043316 A1 * 2/2013 Liu ..... H01Q 1/2225 235/492
2013/0187830 A1 * 7/2013 Warnick ..... H01Q 9/0428 343/893
2016/0164182 A1 * 6/2016 Lai ..... H01Q 21/006 343/905
2016/0365632 A1 * 12/2016 Lee ..... H01Q 9/0442
2017/0126046 A1 * 5/2017 Contopanagos ..... H01Q 1/364
2019/0020110 A1 * 1/2019 Paulotto ..... H01Q 19/005
2020/0106183 A1 * 4/2020 Fabrega Sanchez .. H01Q 5/378
2020/0168996 A1 * 5/2020 Nasimuddin ..... H01Q 5/307
2020/0227829 A1 * 7/2020 Jouanlanne ..... H01Q 5/335
2020/0266529 A1 * 8/2020 Moussakhani ..... H01Q 1/38
2020/0335874 A1 * 10/2020 Mizusaki ..... H01Q 9/0457
2020/0343633 A1 * 10/2020 Yasuo ..... H01Q 3/36

OTHER PUBLICATIONS

International Search Report for International Application No. PCT/SG2018/050118 dated Jun. 7, 2018, pp. 1-4.
Written Opinion of the International Searching Authority for International Application No. PCT/SG2018/050118 dated Jun. 7, 2018, pp. 1-4.

* cited by examiner

400

500

600

800

900

1000

COMPACT WIDEBAND HIGH GAIN CIRCULARLY POLARIZED ANTENNA

CROSS-REFERENCE TO RELATED APPLICATION(S)

This application claims the benefit of Singapore Patent Application No. 10201702690U, entitled "Compact Wideband High Gain Circularly Polarized Antenna" and filed on Mar. 31, 2017, which is expressly incorporated by reference herein in its entirety.

TECHNICAL FIELD

Various aspects of this disclosure generally relate to wireless communication, and more particularly, to a wideband circularly polarized antenna.

BACKGROUND

Wideband circularly polarized (CP) antennas receive much attention these days due to their increasing importance in commercial and defence wireless communication systems. Wideband circularly polarized antennas are insensitive to antenna orientation, which may be useful for various wireless communication systems such as global positioning system, radio frequency identification, wireless local area network, satellite, radar, and so on.

The single-feed, low-profile, high gain, wideband, CP microstrip antenna design is very challenging since it is difficult to excite two orthogonal modes with equal magnitude and 90° phase shift across a wide frequency range. Many traditional techniques have been developed to improve the gain and CP radiation bandwidth. These traditional techniques may include stacked patches, dual-feed structures, array antenna using sequential feeding network, and multi-layered structures. Since traditional antenna techniques are based on multi-radiating patches or a complicated feeding structure, it may be difficult to keep the CP antenna compact.

SUMMARY

The following presents a simplified summary in order to provide a basic understanding of various aspects of the disclosed invention. This summary is not an extensive overview of all contemplated aspects, and is intended to neither identify key or critical elements of all aspects nor delineate the scope of any or all aspects. The sole purpose is to present some concepts of one or more aspects in a simplified form as a prelude to the more detailed description that is presented later.

In one aspect of the disclosure, a compact wideband single feed CP antenna is provided. The antenna may include a patch radiator with embedded ring-shaped slot and grounded via, a slit-slotted parasitic square patch, and a coaxial probe. An antenna design of some embodiments at L-band may exhibit 10-dB return loss bandwidth of 13.7% (1.50 GHz-1.73 GHz), 3-dB axial ratio (AR) bandwidth of 9.2% (1.525 GHz-1.672 GHz), and gain of more than 7.0 dBic across the AR bandwidth with an overall size of $0.457\lambda_0 \times 0.457\lambda_0 0.101\lambda_0$ at 1.525 GHz.

In some embodiments, a circularly polarized antenna is provided. The CP antenna may include a ground plane. The CP antenna may include a radiating patch with an embedded ring-shaped slot. The CP antenna may include a via that shorts a round section of the radiating patch surrounded by the ring-shaped slot to the ground plane. The CP antenna may include a coaxial feed. The inner conductive material of the coaxial feed may be connected to the radiating patch and the outer conductive material of the coaxial feed may touch the ground plane. The CP antenna may include a slit-slotted parasitic square patch.

In some embodiments, the CP antenna may further include a first substrate and a second substrate substantially parallel to the first substrate. In such embodiments, the first substrate and the second substrate may have the same relative permittivity and dielectric loss (loss tangent). In some embodiments, the radiating patch may be positioned on a first surface of the first substrate, the ground plane may be positioned on a second surface of the first substrate, and the slit-slotted parasitic square patch may be positioned on a first surface of the second substrate. In some embodiments, the ring-shaped slot may be positioned at a corner of the radiating patch. In some embodiments, the coaxial feed may connect to the radiating patch on a microstrip stub extended from a central section of an edge of the radiating patch. In some embodiments, the slit-slotted parasitic square patch may include a plurality of slots formed at or edged from each side of the slit-slotted parasitic square patch. The slit-slotted parasitic square patch may further include a round-shaped slot that substantially overlays the ring-shaped slot on the radiating patch.

In one aspect of the disclosure, an antenna array is provided. The antenna array may include a plurality of circularly polarized antennas. Each circularly polarized antenna may include a ground plane. Each circularly polarized antenna may include a radiating patch with an embedded ring-shaped slot. Each circularly polarized antenna may include a via that shorts a round section of the radiating patch surrounded by the ring-shaped slot to the ground plane. Each circularly polarized antenna may include a coaxial feed. The inner conductive material of the coaxial feed may be connected to the radiating patch and the outer conductive material of the coaxial feed may touch the ground plane. Each circularly polarized antenna may include a slit-slotted parasitic square patch. The antenna array may include a feeding network that connects the coaxial feeds of the plurality of circularly polarized antennas. In some embodiments, the plurality of circularly polarized antennas may be arranged as a two dimensional array of antennas.

In some embodiments, a 2×2 CP antenna array is designed to achieve the high gain and wideband radiation with compact size. The 3-dB axial-ratio bandwidth is 10.7% (1.51 GHz-1.68 GHz) and the 10-dB return loss bandwidth is 16.8% (1.456 GHz-1.724 GHz). Greater than 11.0 dBic boresight gain may be achieved across the frequency range from 1.518 GHz to 1.68 GHz with variation of 0.5 dB.

In one aspect of the disclosure, a method for manufacturing a CP antenna is provided. The method may include placing a ground plane. The method may include placing a radiating patch. The method may include etching a ring-shaped slot on the radiating patch. The method may include placing a via that shorts a round section of the radiating patch surrounded by the ring-shaped slot to the ground plane. The method may include placing a coaxial feed. The inner conductive material of the coaxial feed may be connected to the radiating patch and the outer conductive material of the coaxial feed may touch the ground plane. The method may include placing a slit-slotted parasitic square patch.

In some embodiments, the method may further place a first substrate and a second substrate substantially parallel to the first substrate. In such embodiments, the first substrate and the second substrate may have the same relative permittivity and dielectric loss (loss tangent). In some embodiments, the radiating patch may be positioned on a first surface of the first substrate, the ground plane may be positioned on a second surface of the first substrate, and the slit-slotted parasitic square patch may be positioned on a first surface of the second substrate.

To the accomplishment of the foregoing and related ends, the aspects disclosed include the features hereinafter fully described and particularly pointed out in the claims. The following description and the annexed drawings set forth in detail illustrate certain features of the aspects of the disclosure. These features are indicative, however, of but a few of the various ways in which the principles of various aspects may be employed, and this description is intended to include all such aspects and their equivalents.

DETAILED DESCRIPTION

The detailed description set forth below in connection with the appended drawings is intended as a description of various possible configurations and is not intended to represent the only configurations in which the concepts described herein may be practiced. The detailed description includes specific details for the purpose of providing a thorough understanding of various concepts. However, it will be apparent to those skilled in the art that these concepts may be practiced without these specific details. In some instances, well-known structures and components are shown in block diagram form in order to avoid obscuring such concepts.

Several aspects of generating a compact wideband high gain circularly polarized antenna will now be presented with reference to various apparatus and methods. The apparatus and methods will be described in the following detailed description and illustrated in the accompanying drawings by various blocks, components, circuits, processes, algorithms, etc. (collectively referred to as "elements"). These elements may be implemented using electronic hardware, computer software, or any combination thereof. Whether such elements are implemented as hardware or software depends upon the particular application and design constraints imposed on the overall system.

Figure 1:
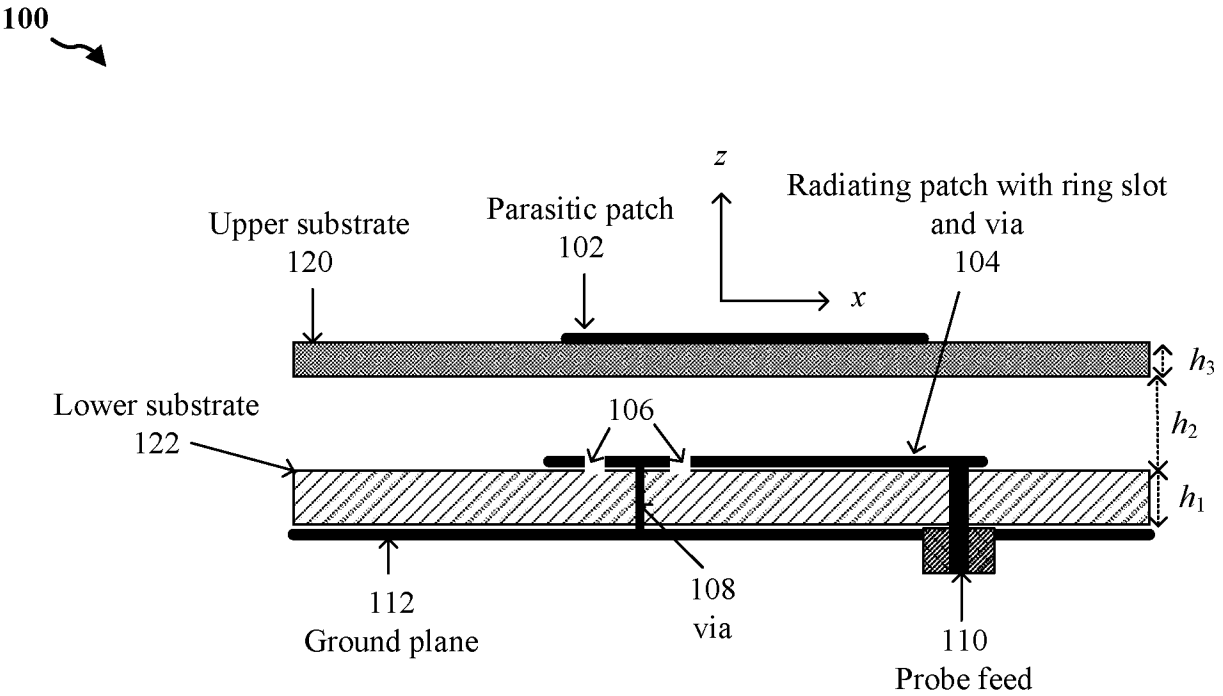
FIG. 1 is a cross-sectional view of a circularly polarized antenna in accordance with one embodiment of the disclosure.

FIG. 1 is a cross-sectional view of a circularly polarized antenna 100 in accordance with one embodiment of the disclosure. As illustrated, the cross-sectional view is in xz-plane. The CP antenna 100 may include a parasitic patch 102, a radiating patch 104, a ground plane 112, and a coaxial probe feed 110.

In some embodiments, the radiating patch 104 may be a square patch. The radiating patch 104 may have a ring slot 106. The section of the radiating patch 104 surrounded by the ring slot 106 may be connected to the ground plane by via 108. The inner conductive material of the coaxial probe feed 110 is connected to the radiating patch 104, and the outer conductive material of the coaxial probe feed 110 touches the ground plane 112.

The CP antenna 100 may include an upper substrate 120, and a lower substrate 122 that is substantially parallel to the upper substrate 120. The parasitic patch 102 may be positioned on the upper layer of the upper substrate 120. The radiating patch 104 may be positioned on the upper layer of the lower substrate 122. The ground plane 112 may be positioned on the lower layer of the lower substrate 122. In some embodiments, the parasitic patch 102, the radiating patch 104, and the ground plane 112 are substantially parallel to each other. In some embodiments, the parasitic patch 102 may substantially overlay the radiating patch 104.

In one embodiment, the CP antenna 100 may have an overall size of 90.0 mm×90.0 mm×20.0 mm. The length of each side of the square radiating patch 104 may be 44.5 mm. The thickness $h_1$ of the lower substrate 122 may be 3.048 mm. The relative permittivity of the lower substrate 122 may be 3.4. The dielectric loss (loss tangent) of the lower substrate 122 may be 0.0027. The thickness $h_3$ of the upper substrate 120 may be 1.524 mm. The relative permittivity of the upper substrate 120 may be 3.4. The dielectric loss (loss tangent) of the upper substrate 120 may be 0.0027.

In some embodiments, the length of each side of the square radiating patch 104 may be less than half of the length of the corresponding side of the ground plane 112. In some embodiments, the lower substrate 122 and the upper substrate 120 may have the same relative permittivity and dielectric loss (loss tangent). In some embodiments, the thickness $h_3$ of the upper substrate 120 may be half of the thickness $h_1$ of the lower substrate 122. In some embodiments, the distance $h_2$ between the upper substrate 120 and the lower substrate 122 may be greater than the thickness $h_1$ of the lower substrate 122.

Figure 2:
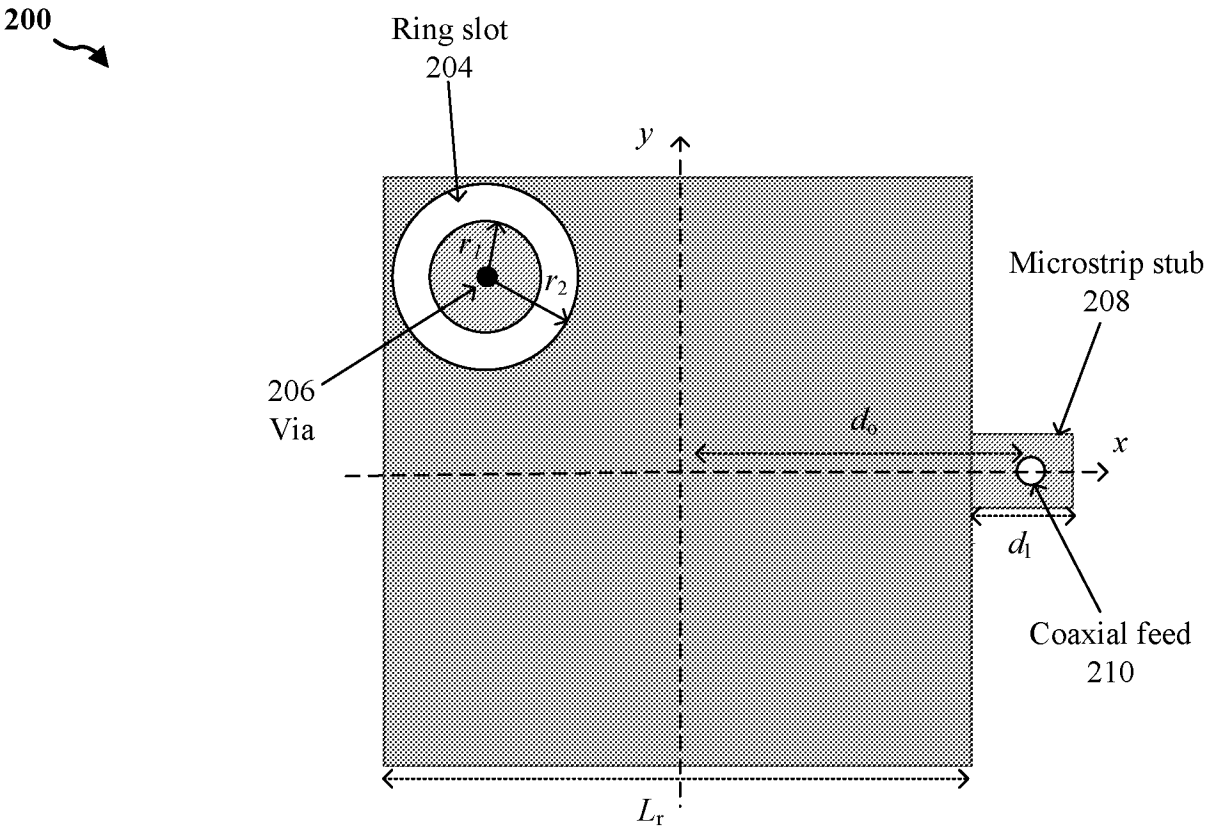
FIG. 2 is a top view of a square radiating patch of some embodiments with embedded ring-shaped slot and via.

FIG. 2 is a top view of a square radiating patch 200 of some embodiments with embedded ring-shaped slot 204 and via 206. As illustrated, the top view is in xy-plane. In some embodiments, the square radiating patch 200 may be the radiating patch 104 described above with reference to FIG. 1, the ring-shaped slot 204 may be the ring slot 106 described above with reference to FIG. 1, and the via 206 may be the via 108 described above with reference to FIG.

1. In one embodiment, the length $L_r$ of each side of the square radiating patch 200 may be 44.5 mm.

The ring-shaped slot 204 has an inner circle and an outer circle. In one embodiment, the radius $r_1$ of the inner circle may be 7.9 mm and the radius $r_2$ of the outer circle may be 8.5 mm. In some embodiments, the center of the inner circle and outer circle of the ring-shaped slot 204 is located at a diagonal line of the square radiating patch 200. In one embodiment, a point on the outer circle of the ring-shaped slot 204 may be positioned at the location of (−10 mm, 10 mm) from the center of the square radiating patch 200. In some embodiments, the ring-shaped slot 204 may be located at a corner of the square radiating patch 200. In some embodiments, the center of the inner circle and outer circle of the ring-shaped slot 204 may be closer to a vertex of the square radiating patch 200 than to the center of the square radiating patch 200. In some embodiments, via 206 is connected to a section of the square radiating patch 200 surrounded by the ring-shaped slot 204.

In some embodiments, a coaxial feed 210 is located along the x-axis on a microstrip stub 208. In some embodiments, the coaxial feed 210 may be the coaxial probe feed 100 described above with reference to FIG. 1. In one embodiment, the distance $d_0$ from the coaxial feed 210 to the center of the square radiating patch 200 may be 35.0 mm. In one embodiment, the length $d_1$ of the microstrip stub 208 along x-axis may be 17.8 mm. In some embodiments, the microstrip stub 208 may extend from a side of the square radiating patch 200 that is opposite to the ring-shaped slot 204 in relation to the center of the square radiating patch 200. In such embodiments, the microstrip stub 208 may be extended from a central section of the side of the square radiating patch 200.

Figure 3:
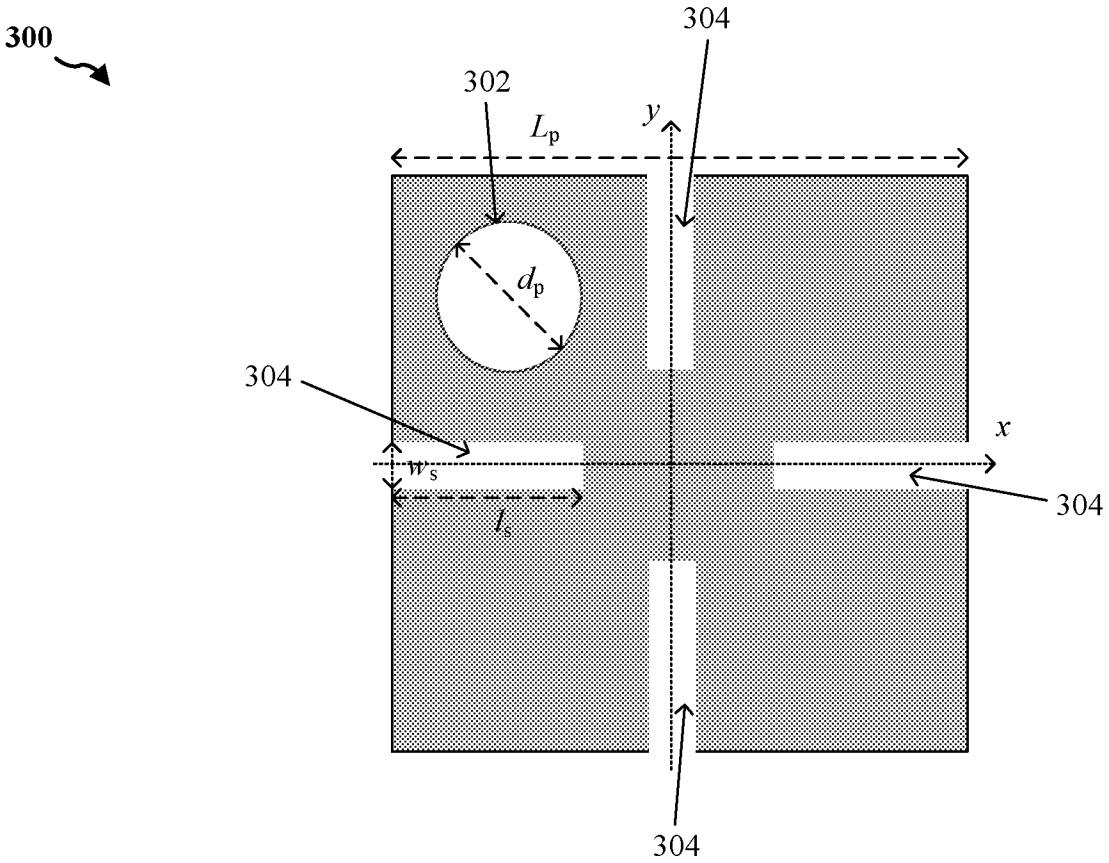
FIG. 3 is a top view of a slotted-slit parasitic square patch of some embodiments.

FIG. 3 is a top view of a slotted-slit parasitic square patch 300 of some embodiments. As illustrated, the top view is in xy-plane. In some embodiments, the slotted-slit parasitic square patch 300 may be the parasitic patch 102 described above with reference to FIG. 1. The length of each side of the slotted-slit parasitic square patch 300 may be $L_p$. In some embodiments, $L_p$, may be substantially equal to or slightly less than the length $L_r$ of each side of the square radiating patch 200 described above in FIG. 2.

In some embodiments, the slotted-slit parasitic square patch 300 may have a round-shaped slot 302. The diameter of the round-shaped slot 302 may be $d_p$. In some embodiments, the round-shaped slot 302 may be aligned with the ring-shaped slot 204 of the square radiating patch 200 described above in FIG. 2, and substantially overlay the ring-shaped slot 204. In such embodiments, $d_p$ may be substantially equal to $2\times r_2$.

In some embodiments, the slotted-slit parasitic square patch 300 may have four rectangle-shaped slots 304 formed at or edged from each side of the slotted-slit parasitic square patch 300. Each rectangle-shaped slot 304 may have length $l_s$ and width $w_s$. In some embodiments, $l_s$ is the length of the sides of a rectangle-shaped slot 304 that are perpendicular to the side of the slotted-slit parasitic square patch 300 at which the rectangle-shaped slot 304 is formed, and $w_s$ is the length of the sides of the rectangle-shaped slot 304 that are parallel to the side of the slotted-slit parasitic square patch 300 at which the rectangle-shaped slot 304 is formed. In some embodiments, $l_s$ may be substantially greater than $w_s$. In one embodiment, $l_s$ may be greater than $2\times w_s$. In one embodiment, $l_s$ may be greater than $3\times w_s$.

In some embodiments of the disclosure, a circularly polarized antenna (e.g., the CP antenna 100) is provided. The CP antenna may include a ground plane (e.g., the ground plane 112). The CP antenna may include a radiating patch (e.g., the radiating patch 104, 200) with an embedded ring-shaped slot (e.g., the ring slot 106, 204). The CP antenna may include a via (e.g., via 108, 206) that shorts a round section of the radiating patch surrounded by the ring-shaped slot to the ground plane. The CP antenna may include a coaxial feed (e.g., the coaxial probe feed 110, 210). The inner conductive material of the coaxial feed may be connected to the radiating patch and the outer conductive material of the coaxial feed may touch the ground plane. The CP antenna may include a slit-slotted parasitic square patch (e.g., the parasitic patch 102, 300).

In some embodiments, the circularly polarized antenna may further include a first substrate (e.g., the lower substrate 122) and a second substrate (e.g., the upper substrate 120) substantially parallel to the first substrate. In such embodiments, the first substrate and the second substrate may have the same relative permittivity and dielectric loss (loss tangent). In some embodiments, the radiating patch may be positioned on a first surface (e.g., the upper surface) of the first substrate, the ground plane may be positioned on a second surface (e.g., the lower surface) of the first substrate, and the slit-slotted parasitic square patch may be positioned on a first surface (e.g., the upper surface) of the second substrate.

In some embodiments, the ring-shaped slot may be positioned at a corner of the radiating patch. In some embodiments, the coaxial feed may connect to the radiating patch on a microstrip stub (e.g., the microstrip stub 208) extended from a central section of an edge of the radiating patch.

In some embodiments, the slit-slotted parasitic square patch may include a plurality of slots (e.g., the rectangle-shaped slots 304) formed at or edged from each side of the slit-slotted parasitic square patch. In some embodiments, the slit-slotted parasitic square patch may include a round-shaped slot (e.g., the round-shaped slot 302) that substantially overlays the ring-shaped slot on the radiating patch.

Figure 4:
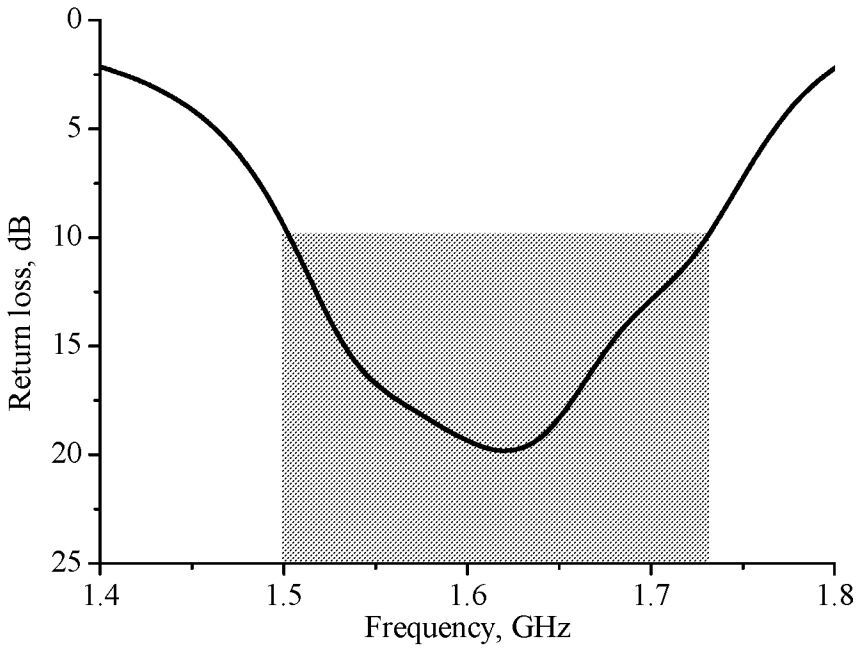
FIG. 4 is a chart illustrating the return loss of a circularly polarized antenna of some embodiments.
Figure 5:
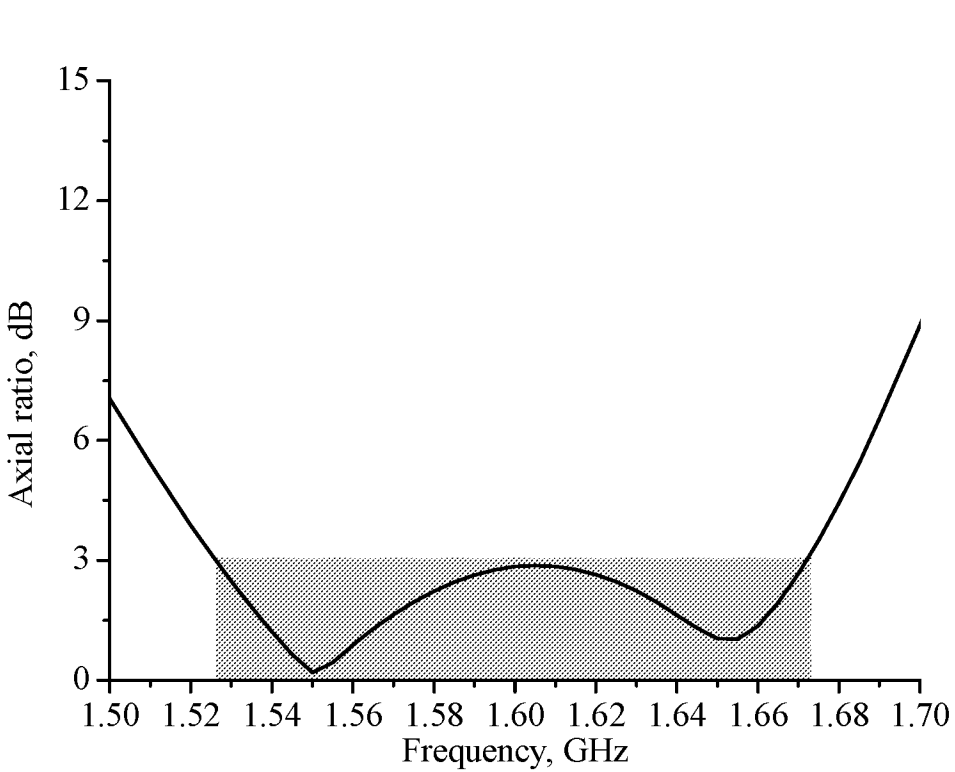
FIG. 5 is a chart illustrating the axial ratio of a circularly polarized antenna of some embodiments at the boresight.
Figure 6:
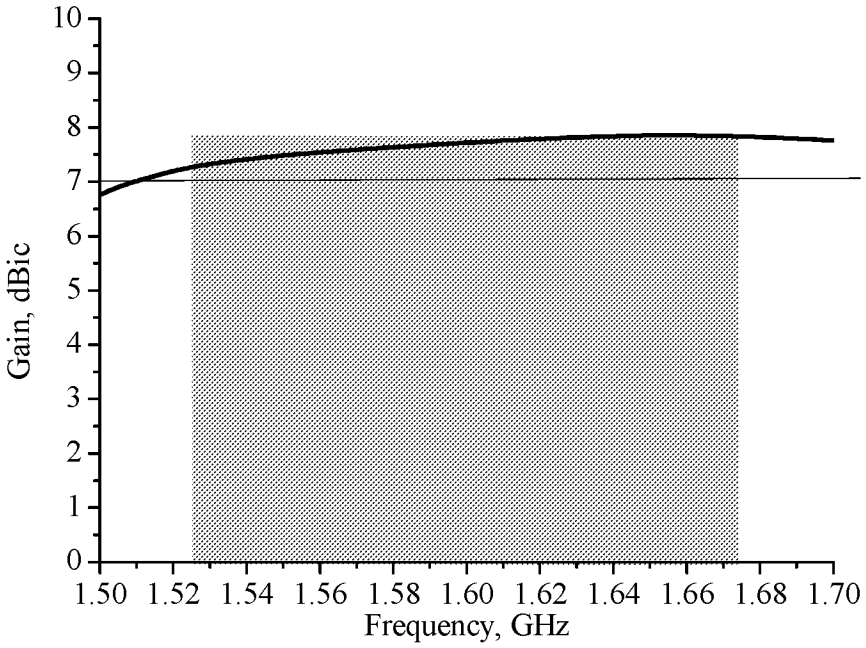
FIG. 6 is a chart illustrating the gain of a circularly polarized antenna of some embodiments at the boresight.

FIG. 4 is a chart 400 illustrating the return loss of a circularly polarized antenna of some embodiments. As shown, the 10-dB return loss bandwidth of some embodiments is 14.7% (1.50 GHz-1.73 GHz). FIG. 5 is a chart 500 illustrating the axial ratio of a circularly polarized antenna of some embodiments at the boresight. As shown, the 3-dB axial ratio bandwidth of some embodiments is 9.2% (1.525 GHz-1.672 GHz). FIG. 6 is a chart 600 illustrating the gain of a circularly polarized antenna of some embodiments at the boresight. As shown, the gain of some embodiments is more than 7.0 dBic from 1.525 GHz to 1.672 GHz.

Figure 7A:
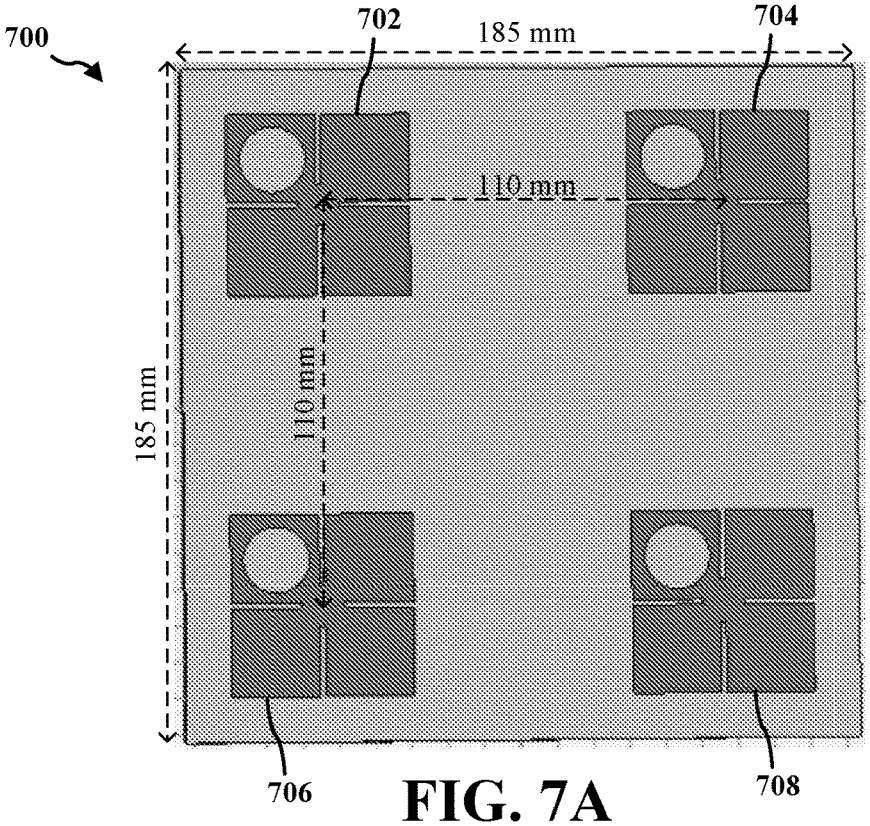
FIG. 7A is a top view of an example of 2×2 antenna array.

FIG. 7A is a top view of an example of 2×2 antenna array 700. In the example, the antenna array 700 includes CP antennas 702, 704, 706, 708 arranged in a 2×2 array. Each of the CP antennas 702, 704, 706, 708 may be the CP antenna described above with reference to FIGS. 1-3.

In one embodiment, the size of the antenna array 700 may be 185 mm×185 mm×18 mm. In one embodiment, the size of the antenna array 700 may be $0.936\lambda_0\times0.936\lambda_0\times0.0.091\lambda_0$ at 1.518 GHz. In one embodiment, the CP antennas 702, 704, 706, 708 may be positioned with a spacing of 110 mm. The spacing between two horizontally or vertically adjacent CP antennas is the distance from one point on one of the two adjacent CP antenna to a corresponding point on the other CP antenna. For example, the distance from one point on the CP antenna 702 to a corresponding point on the CP antenna 704 is 110 mm. Similarly, the distance from one point on the CP antenna 702 to a corresponding point on the CP antenna 706 is 110 mm. In some embodiments, the spacing between two vertically or horizontally adjacent CP antennas may be greater than 2 times of $L_r$ or $L_p$, but less than 3 times of $L_r$ or $L_p$.

Figure 7B:
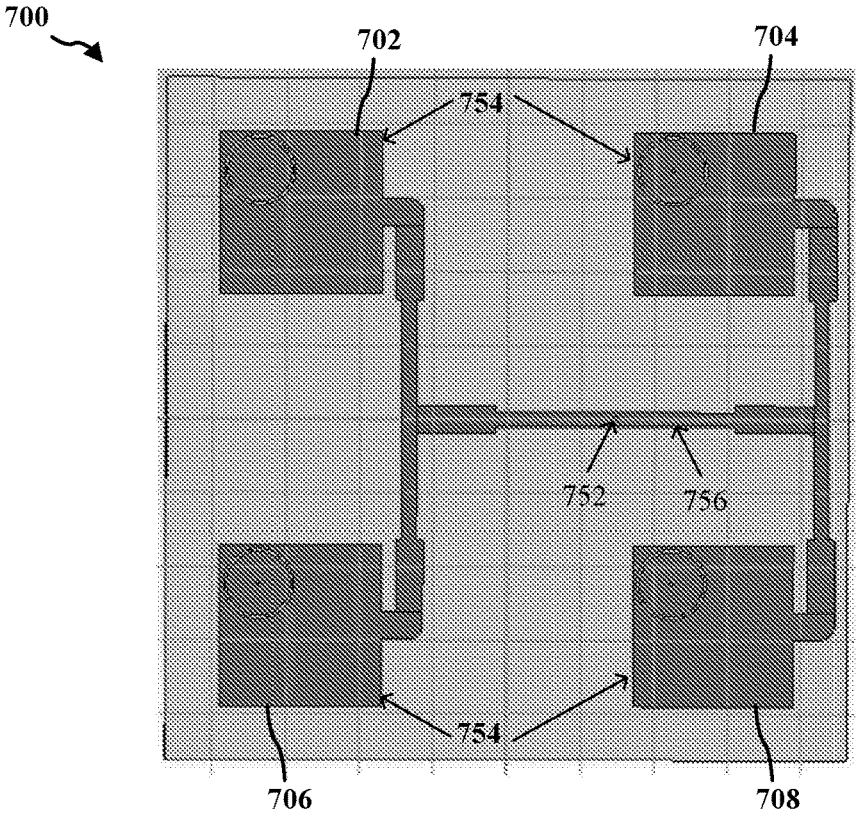
FIG. 7B illustrates an example of a feeding network of the antenna array.

FIG. 7B illustrates an example of a feeding network 756 of the antenna array 700. In the example, the feeding network 756 connects the radiating patches 754 of the CP antennas 702, 704, 706, 708 to the probe feed 752 so that the CP antennas 702, 704, 706, 708 work together as a single antenna, to transmit or receive radio waves. In some embodiments, the feeding network 756 may connect the coaxial feeds of the CP antennas 702, 704, 706, 708 to the probe feed 752.

In some embodiments of the disclosure, an antenna array (e.g., the antenna array 700) is provided. The antenna array may include a plurality of circularly polarized antennas (e.g., the CP antennas 702, 704, 706, 708). Each of the plurality of circularly polarized antennas may include a ground plane (e.g., the ground plane 112). Each of the plurality of circularly polarized antennas may include a radiating patch (e.g., the radiating patch 104, 200) with an embedded ring-shaped slot (e.g., the ring slot 106, 204). Each of the plurality of circularly polarized antennas may include a via (e.g., via 108 or 206) that shorts a round section of the radiating patch surrounded by the ring-shaped slot to the ground plane. Each of the plurality of circularly polarized antennas may include a coaxial feed (e.g., the coaxial probe feed 110, 210). The inner conductive material of the coaxial feed may be connected to the radiating patch and the outer conductive material of the coaxial feed may touch the ground plane. Each of the plurality of circularly polarized antennas may include a slit-slotted parasitic square patch (e.g., the parasitic patch 102, 300). The antenna array may include a feeding network (e.g., the feeding network 756) that connects the coaxial feeds of the plurality of circularly polarized antennas.

In some embodiments, each of the plurality of circularly polarized antennas may further include a first substrate (e.g., the lower substrate 122) and a second substrate (e.g., the upper substrate 120) substantially parallel to the first substrate. In such embodiments, the first substrate and the second substrate may have the same relative permittivity and dielectric loss (loss tangent). In some embodiments, the radiating patch may be positioned on a first surface (e.g., the upper surface) of the first substrate, the ground plane may be positioned on a second surface (e.g., the lower surface) of the first substrate, and the slit-slotted parasitic square patch may be positioned on a first surface (e.g., the upper surface) of the second substrate.

In some embodiments, the ring-shaped slot may be positioned at a corner of the radiating patch. In some embodiments, the coaxial feed may connect to the radiating patch on a microstrip stub (e.g., the microstrip stub 208) extended from a central section of an edge of the radiating patch.

In some embodiments, the slit-slotted parasitic square patch may include a plurality of slots (e.g., the rectangle-shaped slots 304) formed at or edged from each side of the slit-slotted parasitic square patch. In some embodiments, the slit-slotted parasitic square patch may include a round-shaped slot (e.g., the round-shaped slot 302) that substantially overlays the ring-shaped slot on the radiating patch. In some embodiments, the plurality of circularly polarized antennas may be arranged as a two dimensional array of antennas.

Figure 8:
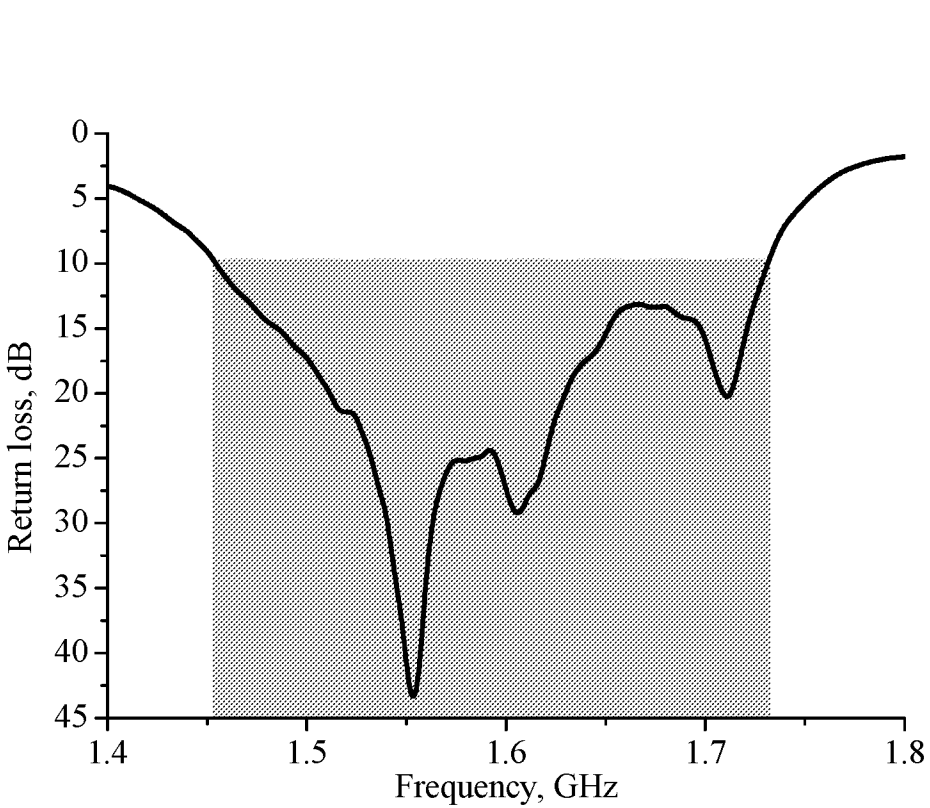
FIG. 8 is a chart illustrating the measured return loss of the antenna array described above with reference to FIGS. 7A and 7B.
Figure 9:
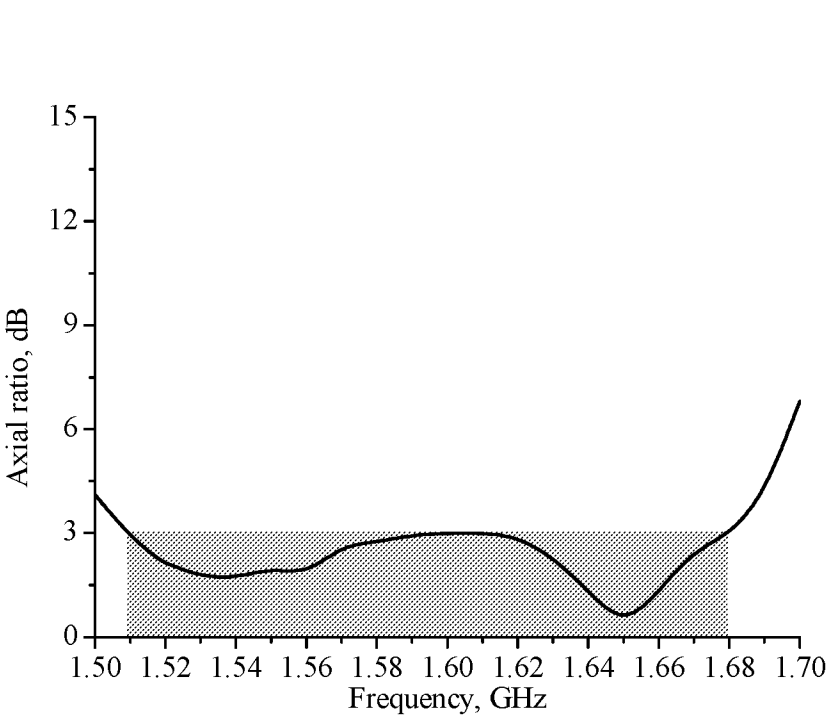
FIG. 9 is a chart illustrating the measured axial ratio of the antenna array described above at the boresight.
Figure 10:
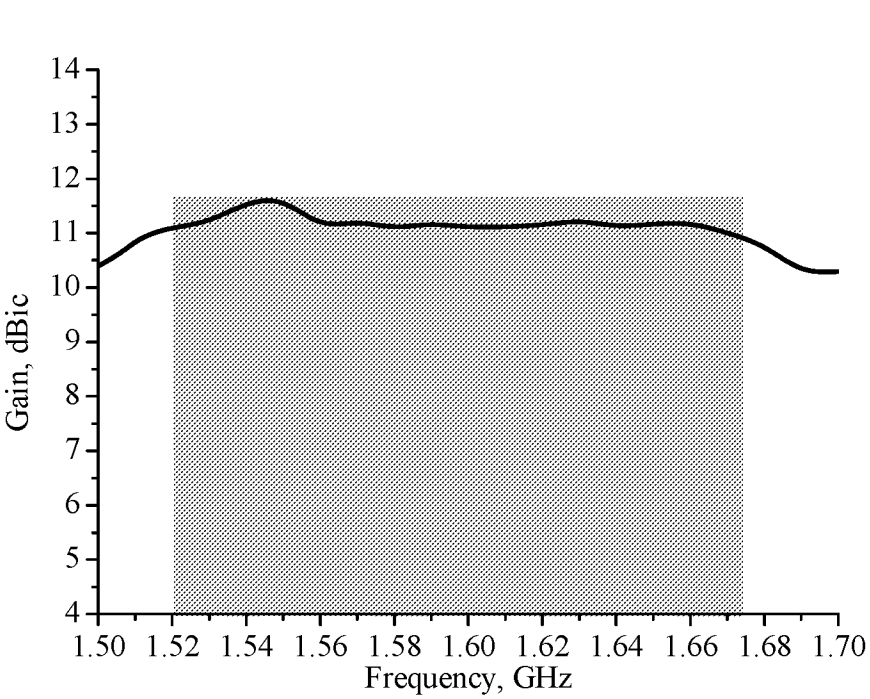
FIG. 10 is a chart illustrating the measured gain of the antenna array described above at the boresight.

FIG. 8 is a chart 800 illustrating the measured return loss of the antenna array 700 described above with reference to FIGS. 7A and 7B. As shown, the 10-dB return loss bandwidth of the antenna array 700 is 16.8% (1.456 GHz-1.724 GHz). FIG. 9 is a chart 900 illustrating measured axial ratio of the antenna array 700 at the boresight. As shown, the 3-dB axial ratio bandwidth of the antenna array 700 is 10.7% (1.51 GHz-1.68 GHz). FIG. 10 is a chart 1000 illustrating measured gain of the antenna array 700 at the boresight. As shown, the measured boresight gain of greater than 11.0 dBic is achieved across the frequency range from 1.518 GHz to 1.68 GHz with variation of 0.5 dB. The maximum gain of 11.5 dBic is achieved at 1.55 GHz.

Figure 11:
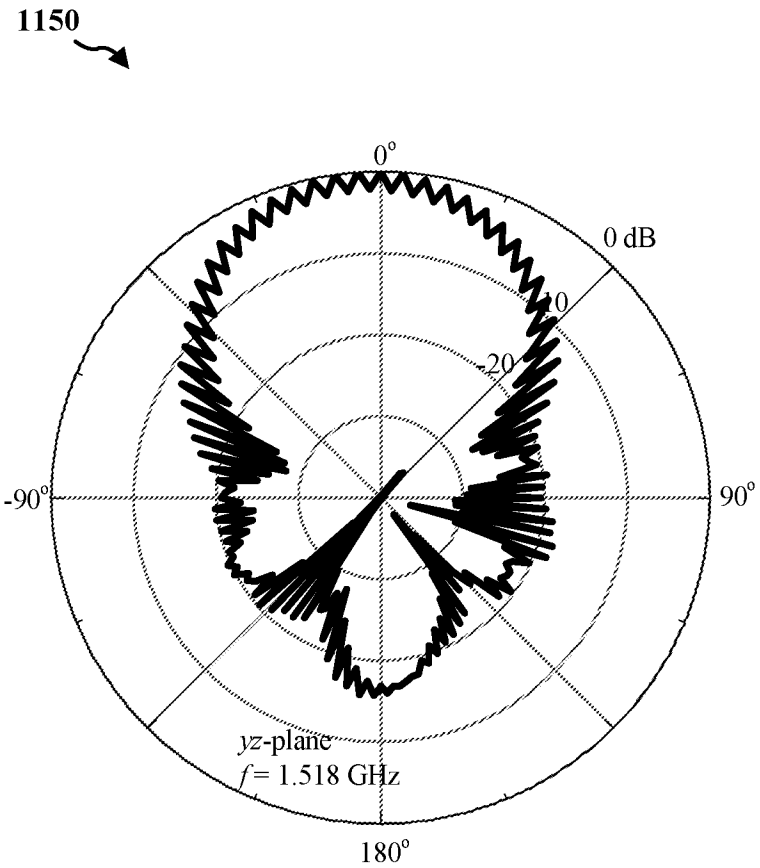
FIG. 11 illustrates the measured normalized radiation patterns in xz-plane and yz-plane at 1.518 GHz.
Figure 11:
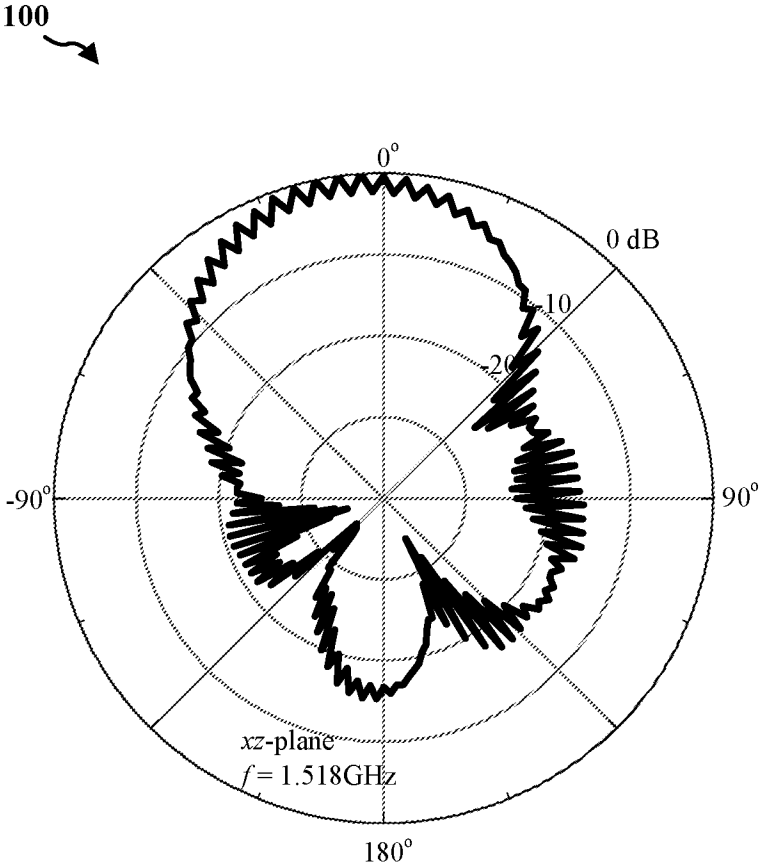
Figure 12:
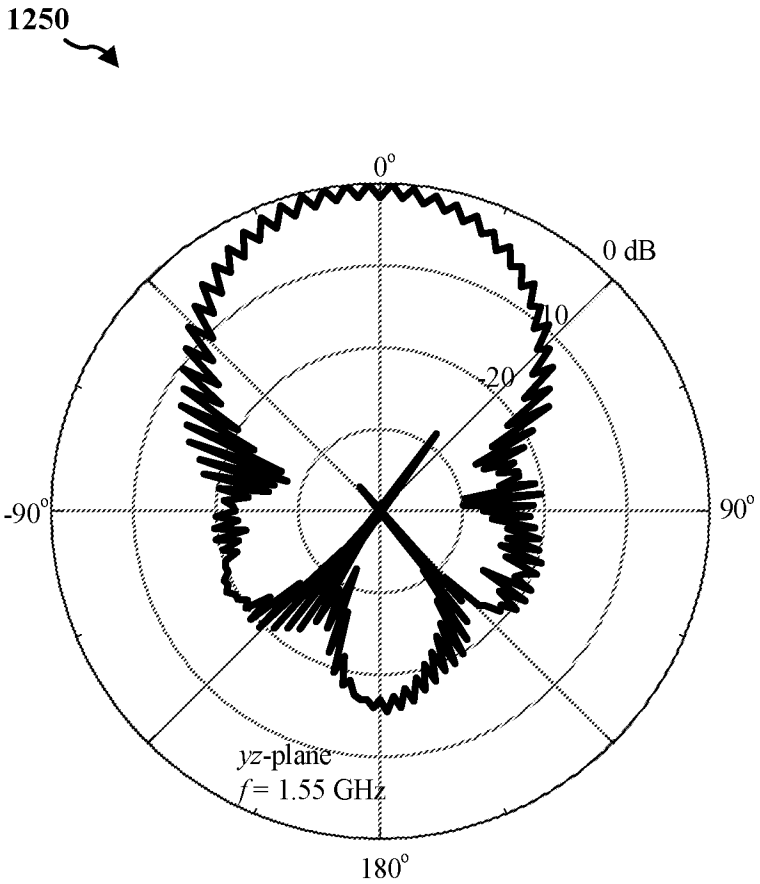
FIG. 12 illustrates the measured normalized radiation patterns in xz-plane and yz-plane at 1.55 GHz.
Figure 12:
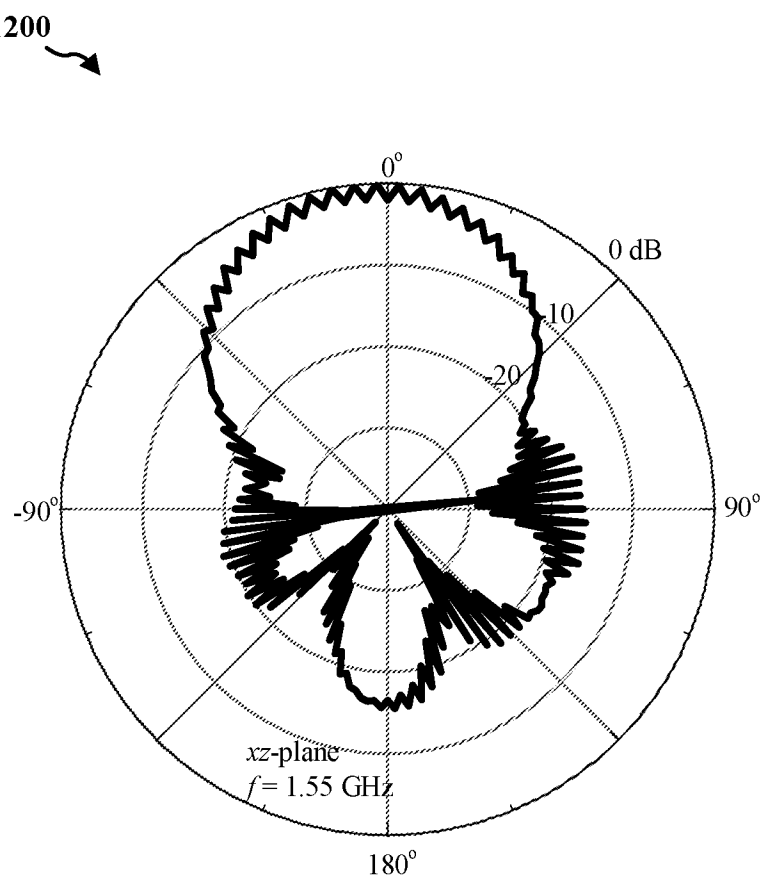
Figure 13:
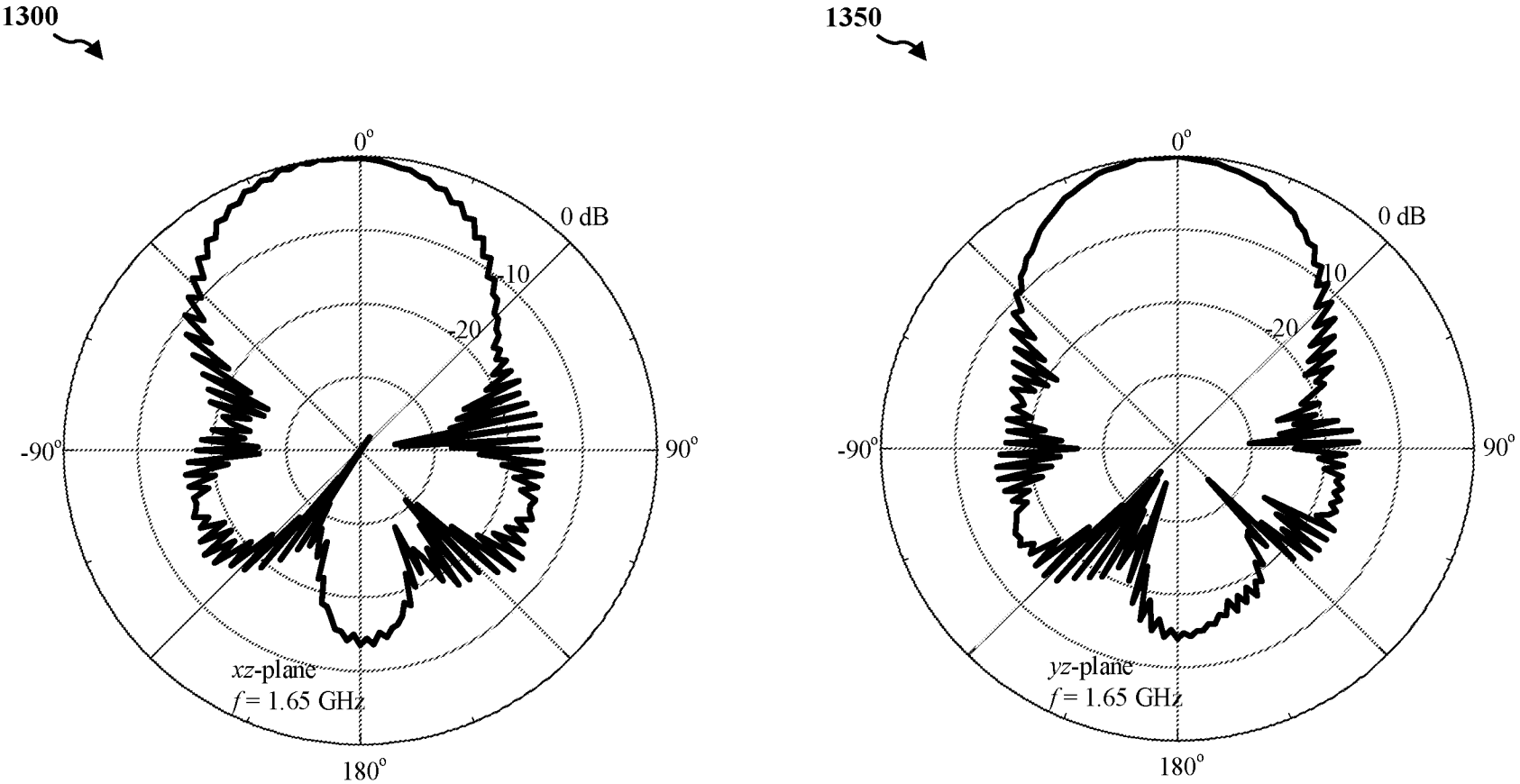
FIG. 13 illustrates the measured normalized radiation patterns in xz-plane and yz-plane at 1.65 GHz.
Figure 14:
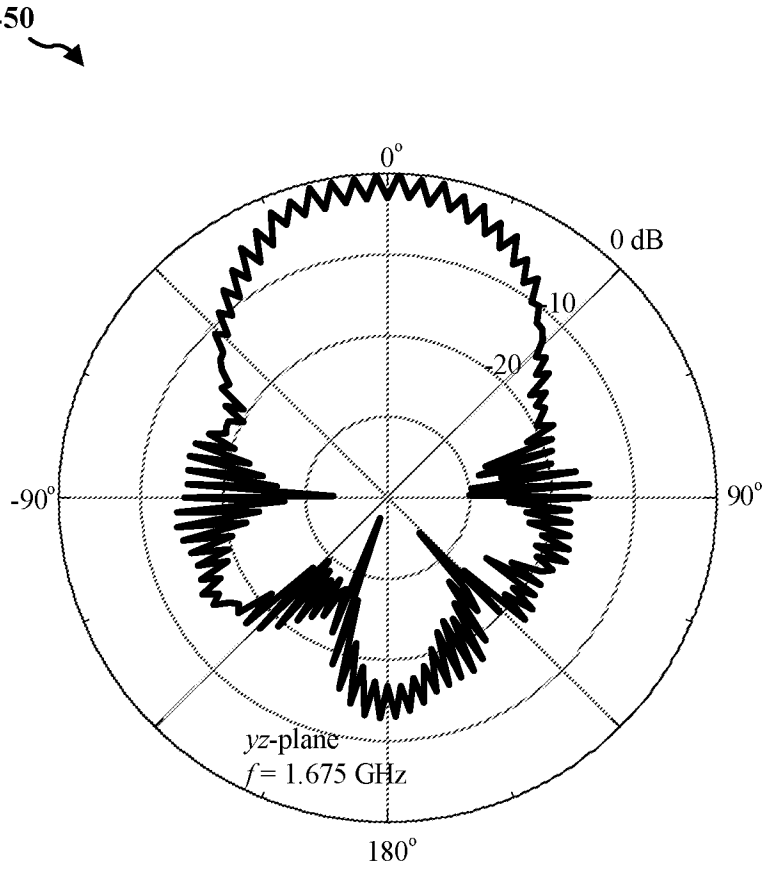
FIG. 14 illustrates the measured normalized radiation patterns in xz-plane and yz-plane at 1.675 GHz.
Figure 14:
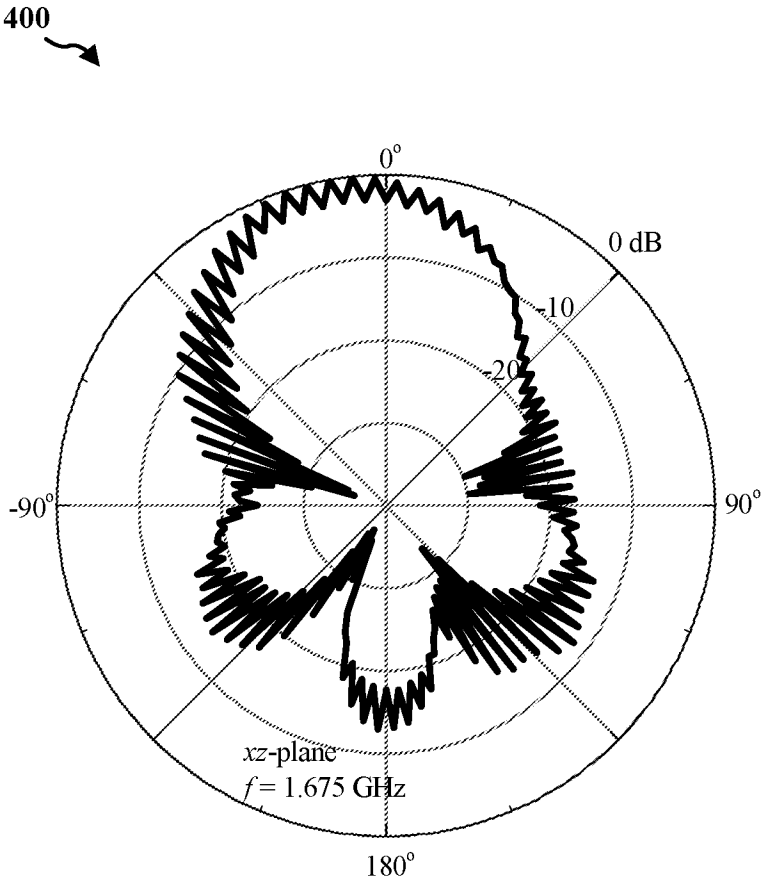

FIGS. 11-14 illustrate the measured normalized radiation patterns of the 2×2 antenna array 700 described above in FIGS. 7A and 7B at different frequencies. FIG. 11 illustrates the measured normalized radiation patterns 1100 and 1150 in xz-plane and yz-plane, respectively, at 1.518 GHz. FIG. 12 illustrates the measured normalized radiation patterns 1200 and 1250 in xz-plane and yz-plane, respectively, at 1.55 GHz. FIG. 13 illustrates the measured normalized radiation patterns 1300 and 1350 in xz-plane and yz-plane, respectively, at 1.65 GHz. FIG. 14 illustrates the measured normalized radiation patterns 1400 and 1450 in xz-plane and yz-plane, respectively, at 1.675 GHz. The ripples in the radiation patterns 1100, 1150, 1200, 1250, 1300, 1350, 1400, 1450 represent the value of axial ratio. As shown in FIGS. 11-14, the antenna 700 has consistent radiation patterns in xz-plane and yz-plane across a broad range of frequencies.

Figure 15:
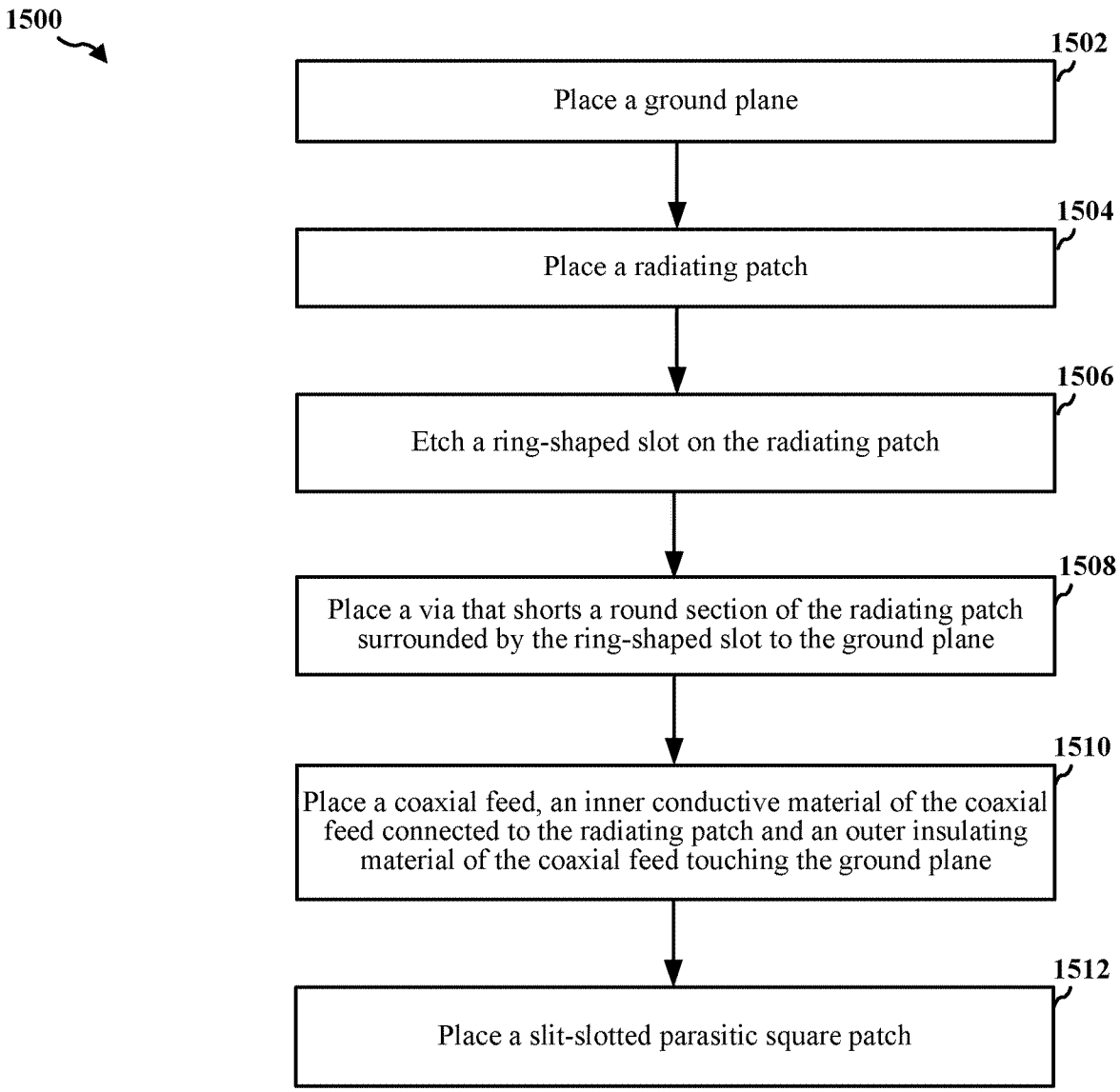
FIG. 15 is a flowchart of a method of manufacturing a compact wideband circularly polarized antenna.

FIG. 15 is a flowchart 1500 of a method of manufacturing a compact wideband circularly polarized antenna. In some embodiments, the CP antenna manufactured by this method may be the CP antenna described above with reference to FIGS. 1-3. At 1502, the method may place a ground plane.

At 1504, the method may place a radiating patch. In some embodiments, the surface area of the radiating patch may be substantially smaller than the ground plane to reduce coupling effects between the radiating element and the ground plane, and to mitigate reduction in antenna gain.

At 1506, the method may etch a ring-shaped slot on the radiating patch. In some embodiments, the ring-shaped slot may be positioned at a corner of the radiating patch.

At 1508, the method may place a via that shorts a round section of the radiating patch surrounded by the ring-shaped slot to the ground plane.

At 1510, the method may place a coaxial feed. The inner conductive material of the coaxial feed may connect to the radiating patch and the outer conductive material of the coaxial feed may touch the ground plane. In some embodiments, the coaxial feed may connect to the radiating patch on a microstrip stub extended from a central section of an edge of the radiating patch.

At 1512, the method may place a slit-slotted parasitic square patch. In some embodiments, the slit-slotted parasitic square patch may include a plurality of slots formed at or edged from each side of the slit-slotted parasitic square patch. The slit-slotted parasitic square patch may include a round-shaped slot that substantially overlays the ring-shaped slot on the radiating patch.

In some embodiments, the method may further place a first substrate and a second substrate substantially parallel to the first substrate. In such embodiments, the first substrate and the second substrate may have the same relative permittivity and dielectric loss (loss tangent). In some embodiments, the radiating patch may be positioned on a first surface of the first substrate, the ground plane may be positioned on a second surface of the first substrate, and the slit-slotted parasitic square patch may be positioned on a first surface of the second substrate.

In the following, various aspects of this disclosure will be illustrated:

Example 1 is a circularly polarized antenna. The CP antenna may include a ground plane, a radiating patch with an embedded ring-shaped slot, a via that shorts a round section of the radiating patch surrounded by the ring-shaped slot to the ground plane, a coaxial feed, and a slit-slotted parasitic square patch. The inner conductive material of the coaxial feed may be connected to the radiating patch and the outer conductive material of the coaxial feed touches the ground plane.

In Example 2, the subject matter of Example 1 may optionally include that the circularly polarized antenna may further include a first substrate and a second substrate substantially parallel to the first substrate.

In Example 3, the subject matter of Example 2 may optionally include that the first substrate and the second substrate may have the same relative permittivity and dielectric loss (loss tangent).

In Example 4, the subject matter of Example 2 may optionally include that the radiating patch may be positioned on a first surface of the first substrate, the ground plane positioned on a second surface of the first substrate, and the slit-slotted parasitic square patch positioned on a first surface of the second substrate.

In Example 5, the subject matter of any one of Examples 1 to 4 may optionally include that the ring-shaped slot may be positioned at a corner of the radiating patch.

In Example 6, the subject matter of any one of Examples 1 to 5 may optionally include that the coaxial feed may connect to the radiating patch on a microstrip stub extended from a central section of an edge of the radiating patch.

In Example 7, the subject matter of any one of Examples 1 to 6 may optionally include that the slit-slotted parasitic square patch may include: a plurality of slots formed at or edged from each side of the slit-slotted parasitic square patch; and a round-shaped slot that substantially overlays the ring-shaped slot on the radiating patch.

Example 8 is an antenna array. The antenna array may include a plurality of circularly polarized antennas. Each of the plurality of CP antennas may include a ground plane, a radiating patch with an embedded ring-shaped slot, a via that shorts a round section of the radiating patch surrounded by the ring-shaped slot to the ground plane, a coaxial feed, and a slit-slotted parasitic square patch. The inner conductive material of the coaxial feed may be connected to the radiating patch and the outer conductive material of the coaxial feed touches the ground plane. The antenna array may include a feeding network that connects the coaxial feeds of the plurality of circularly polarized antennas.

In Example 9, the subject matter of Example 8 may optionally include that each of the plurality of circularly polarized antennas may further include a first substrate and a second substrate substantially parallel to the first substrate.

In Example 10, the subject matter of Example 9 may optionally include that the first substrate and the second substrate may have the same relative permittivity and dielectric loss (loss tangent).

In Example 11, the subject matter of Example 9 may optionally include that the radiating patch may be positioned on a first surface of the first substrate, the ground plane positioned on a second surface of the first substrate, and the slit-slotted parasitic square patch positioned on a first surface of the second substrate.

In Example 12, the subject matter of any one of Examples 8 to 11 may optionally include that the ring-shaped slot may be positioned at a corner of the radiating patch.

In Example 13, the subject matter of any one of Examples 8 to 12 may optionally include that the coaxial feed may connect to the radiating patch on a microstrip stub extended from a central section of an edge of the radiating patch.

In Example 14, the subject matter of any one of Examples 8 to 13 may optionally include that the slit-slotted parasitic square patch may include: a plurality of slots formed at or edged from each side of the slit-slotted parasitic square patch; and a round-shaped slot that substantially overlays the ring-shaped slot on the radiating patch.

In Example 15, the subject matter of any one of Examples 8 to 14 may optionally include that the plurality of circularly polarized antennas may be arranged as a two dimensional array of antennas.

Example 16 is a method of manufacturing a circularly polarized antenna. The method may include placing a ground plane, placing a radiating patch, etching a ring-shaped slot on the radiating patch, placing a via that shorts a round section of the radiating patch surrounded by the ring-shaped slot to the ground plane, placing a coaxial feed, and placing a slit-slotted parasitic square patch. The inner conductive material of the coaxial feed may be connected to the radiating patch and the outer conductive material of the coaxial feed touches the ground plane.

In Example 17, the subject matter of Example 16 may optionally include that the method may further include placing a first substrate and placing a second substrate substantially parallel to the first substrate.

In Example 18, the subject matter of Example 17 may optionally include that the first substrate and the second substrate may have the same relative permittivity and dielectric loss (loss tangent).

In Example 19, the subject matter of Example 17 may optionally include that the radiating patch may be positioned on a first surface of the first substrate, the ground plane positioned on a second surface of the first substrate, and the slit-slotted parasitic square patch positioned on a first surface of the second substrate.

In Example 20, the subject matter of any one of Examples 16 to 19 may optionally include that the ring-shaped slot may be positioned at a corner of the radiating patch.

In Example 21, the subject matter of any one of Examples 16 to 20 may optionally include that the coaxial feed may connect to the radiating patch on a microstrip stub extended from a central section of an edge of the radiating patch.

In Example 22, the subject matter of any one of Examples 16 to 21 may optionally include that the slit-slotted parasitic square patch may include: a plurality of slots formed at or edged from each side of the slit-slotted parasitic square patch; and a round-shaped slot that substantially overlays the ring-shaped slot on the radiating patch.

A person skilled in the art will appreciate that the terminology used herein is for the purpose of describing various embodiments only and is not intended to be limiting of the present invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It is understood that the specific order or hierarchy of blocks in the processes/flowcharts disclosed is an illustration of exemplary approaches. Based upon design preferences, it is understood that the specific order or hierarchy of blocks in the processes/flowcharts may be rearranged. Further, some blocks may be combined or omitted. The accompanying method claims present elements of the various blocks in a sample order, and are not meant to be limited to the specific order or hierarchy presented.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but is to be accorded the full scope consistent with the language claims, wherein reference to an element in the singular is not intended to mean "one and only one" unless specifically so stated, but rather "one or more." The word "exemplary" is used herein to mean "serving as an example, instance, or illustration." Any aspect described herein as "exemplary" is not necessarily to be construed as preferred or advantageous over other aspects. Unless specifically stated otherwise, the term "some" refers to one or more. Combinations such as "at least one of A, B, or C," "one or more of A, B, or C," "at least one of A, B, and C," "one or more of A, B, and C," and "A, B, C, or any combination thereof" include any combination of A, B, and/or C, and may include multiples of A, multiples of B, or multiples of C. Specifically, combinations such as "at least one of A, B, or C," "one or more of A, B, or C," "at least one of A, B, and C," "one or more of A, B, and C," and "ABC or any combination thereof" may be A only, B only, C only, A and B, A and C, B and C, or A and B and C, where any such combinations may contain one or more member or members of A, B, or C. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. The words "module," "mechanism," "element," "device," and the like may not be a substitute for the word "means." As such, no claim element is to be construed as a means plus function unless the element is expressly recited using the phrase "means for."

What is claimed is:

1. A circularly polarized antenna, comprising:
- a ground plane;
- a radiating patch with an embedded ring-shaped slot;
- a via that shorts a round section of the radiating patch surrounded by the ring-shaped slot to the ground plane;
- a coaxial feed, wherein an inner conductive material of the coaxial feed is connected to the radiating patch and an outer conductive material of the coaxial feed touches the ground plane; and
- a slit-slotted parasitic square patch.

2. The circularly polarized antenna of claim 1, further comprising:
- a first substrate; and
- a second substrate substantially parallel to the first substrate.

3. The circularly polarized antenna of claim 2, wherein the first substrate and the second substrate have the same relative permittivity and dielectric loss.

4. The circularly polarized antenna of claim 2, wherein the radiating patch is positioned on a first surface of the first substrate, wherein the ground plane is positioned on a second surface of the first substrate, wherein the slit-slotted parasitic square patch is positioned on a first surface of the second substrate.

5. The circularly polarized antenna of claim 1, wherein the ring-shaped slot is positioned at a corner of the radiating patch.

6. The circularly polarized antenna of claim 1, wherein the coaxial feed connects to the radiating patch on a microstrip stub extended from a central section of an edge of the radiating patch.

7. The circularly polarized antenna of claim 1, wherein the slit-slotted parasitic square patch comprises:
- a plurality of slots formed at or edged from each side of the slit-slotted parasitic square patch; and
- a round-shaped slot that substantially overlays the ring-shaped slot on the radiating patch.

8. An antenna array, comprising:
- a plurality of circularly polarized antennas, each of the plurality of circularly polarized antennas comprises:
  - a ground plane;
  - a radiating patch with an embedded ring-shaped slot;
  - a via that shorts a round section of the radiating patch surrounded by the ring-shaped slot to the ground plane;
  - a coaxial feed, wherein an inner conductive material of the coaxial feed is connected to the radiating patch and an outer conductive material of the coaxial feed touches the ground plane; and
  - a slit-slotted parasitic square patch; and
- a feeding network that connects the coaxial feeds of the plurality of circularly polarized antennas.

9. The antenna array of claim 8, wherein each of the plurality of circularly polarized antennas further comprises:
- a first substrate; and
- a second substrate substantially parallel to the first substrate.

10. The antenna array of claim 9, wherein the first substrate and the second substrate have the same relative permittivity and dielectric loss.

11. The antenna array of claim 9, wherein the radiating patch is positioned on a first surface of the first substrate, wherein the ground plane is positioned on a second surface of the first substrate, wherein the slit-slotted parasitic square patch is positioned on a first surface of the second substrate.

12. The antenna array of claim 8, wherein the ring-shaped slot is positioned at a corner of the radiating patch.

13. The antenna array of claim 8, wherein the coaxial feed connects to the radiating patch on a microstrip stub extended from a central section of an edge of the radiating patch.

14. The antenna array of claim 8, wherein the slit-slotted parasitic square patch comprises:
- a plurality of slots formed at or edged from each side of the slit-slotted parasitic square patch; and
- a round-shaped slot that substantially overlays the ring-shaped slot on the radiating patch.

15. The antenna array of claim 8, wherein the plurality of circularly polarized antennas are arranged as a two dimensional array of antennas.

16. A method of manufacturing a circularly polarized antenna, comprising:
- placing a ground plane;
- placing a radiating patch;
- etching a ring-shaped slot on the radiating patch;
- placing a via that shorts a round section of the radiating patch surrounded by the ring-shaped slot to the ground plane;

placing a coaxial feed, wherein an inner conductive material of the coaxial feed is connected to the radiating patch and an outer conductive material of the coaxial feed touches the ground plane; and placing a slit-slotted parasitic square patch.

17. The method of claim 16, further comprising:

placing a first substrate; and placing a second substrate substantially parallel to the first substrate.

18. The method of claim 17, wherein the first substrate and the second substrate have the same relative permittivity and dielectric loss.

19. The method of claim 17, wherein the radiating patch is positioned on a first surface of the first substrate, wherein the ground plane is positioned on a second surface of the first substrate, wherein the slit-slotted parasitic square patch is positioned on a first surface of the second substrate.

20. The method of claim 16, wherein the ring-shaped slot is positioned at a corner of the radiating patch.

* * * * *